US006740204B2

(12) United States Patent
Kahl et al.

(10) Patent No.: US 6,740,204 B2
(45) Date of Patent: May 25, 2004

(54) APPARATUS FOR TREATING A FIBROUS WEB

(75) Inventors: Peter Kahl, Gerstetten (DE); Uwe Joos, Aalen (DE)

(73) Assignee: Voith Paper Patent GmbH, Heidenheim (DE)

( * ) Notice: Subject to any disclaimer, the term of this patent is extended or adjusted under 35 U.S.C. 154(b) by 0 days.

(21) Appl. No.: 10/205,407

(22) Filed: Jul. 26, 2002

(65) Prior Publication Data

US 2003/0034138 A1 Feb. 20, 2003

(30) Foreign Application Priority Data

Aug. 20, 2001 (DE) ..... 101 40 801

(51) Int. Cl.[7] ..... D21F 5/00; F26B 11/00

(52) U.S. Cl. ..... 162/363; 162/364; 162/374; 162/199; 162/272; 162/207; 162/217; 34/114; 34/122; 277/906

(58) Field of Search ..... 162/363–374, 162/351–352, 199, 204–208, 21, 272–279; 34/114–123, 444, 452–458; 100/156; 277/300, 306, 345, 906

(56) References Cited

U.S. PATENT DOCUMENTS

| | | | | | |
|---|---|---|---|---|---|
| 3,649,449 | A | * | 3/1972 | Nykopp | 162/365 |
| 4,185,399 | A | | 1/1980 | Gladish | |
| 4,492,611 | A | * | 1/1985 | Meinander | 162/358.3 |
| 5,230,168 | A | | 7/1993 | Heinzmann et al. | |
| 6,192,597 | B1 | * | 2/2001 | Kahl et al. | 34/115 |
| 6,247,247 | B1 | * | 6/2001 | Yomaa et al. | 34/425 |
| 6,306,262 | B1 | * | 10/2001 | Snellman et al. | 162/363 |
| 6,317,999 | B1 | * | 11/2001 | Virta et al. | 34/114 |
| 6,574,884 | B1 | * | 6/2003 | Jokinen | 34/114 |
| 2002/0100186 | A1 | * | 8/2002 | Turcotte et al. | 34/444 |

FOREIGN PATENT DOCUMENTS

| | | |
|---|---|---|
| DE | 4033901 | 4/1992 |
| DE | 19716131 | 10/1998 |
| DE | 19817202 | 10/1999 |
| DE | 20017933 | 2/2001 |

* cited by examiner

*Primary Examiner*—Steven P. Griffin
*Assistant Examiner*—Eric Hug
(74) *Attorney, Agent, or Firm*—Greenblum & Bernstein, P.L.C.

(57) ABSTRACT

Apparatus for treating a fibrous web that includes at least one supporting surface arranged to support a surface of the fibrous web, and at least one sealing device positionable adjacent a surface of the web opposite the surface of the web supported by the at least one supporting surface. The at least one sealing device includes a sealing element and a holder structured and arranged to hold and to enable lateral sliding movement of the at least one sealing device cross-wise to a web travel direction.

71 Claims, 3 Drawing Sheets

APPARATUS FOR TREATING A FIBROUS WEB

CROSS-REFERENCE TO RELATED APPLICATION

The present invention claims priority under 35 U.S.C. §119 of German Patent Application No. 101 40 801.3 filed Aug. 20, 2001, the disclosure of which is expressly incorporated by reference herein in its entirety.

BACKGROUND OF THE INVENTION

1. Field of the Invention

The invention relates to an apparatus for treating a fibrous web, e.g., a paper and/or board web, in which the fibrous web, either alone or together with at least one supporting belt, e.g., a dewatering belt, press belt, or mesh belt, is guided over at least one moving or stationary supporting surface. On the side of the fibrous web facing away from the supporting surface, at least one sealing device is provided, which includes a sealing element which is held in a holder.

2. Discussion of Background Information

An apparatus, such as the one generally discussed above, is described, e.g., in German Patent Application No. DE-A-197 16 131.6.

The relevant sealing device is often provided in the area of an air-based device such as in particular a stabilizer box or the like. In this case, an additional vacuum zone can be provided in the upper area of such a stabilizer box. Between the two vacuum zones, that is to say between the upper and the lower vacuum zone a seal can be provided, in particular a seal fixedly mounted on the box.

SUMMARY OF THE INVENTION

The present invention provides an apparatus of the type mentioned at the beginning in which the sealing element can be replaced without difficulty, i.e., replacement may be possible even without dismantling the stabilizer box. If appropriate, the intention is for such a change even to be possible behind the framing part.

According to the invention, the present invention provides an apparatus for treating a fibrous web such as in particular a paper and/or board web, in which the fibrous web, on its own or together with at least one supporting belt, e.g., a dewatering belt, press belt, mesh belt and/or the like, is guided over at least one moving or stationary supporting surface. On the side of the fibrous web facing away from such a supporting surface, at least one sealing device is provided, which includes a sealing element which is held in a holder which is arranged in the immediate vicinity of the supporting belt without touching the latter, i.e., while maintaining a gap between the sealing element and the supporting belt. It is possible for the sealing element to be guided out of the holder laterally, i.e., transversely with respect to the web running direction.

Therefore, the sealing element forming a wearing part can be drawn laterally out of the holder without difficulty, without adjacent devices in the papermaking machine, such as in particular an adjacent stabilizer box or the like, also having to be dismantled for this purpose. It may possibly be necessary, before drawing out the sealing element, for a lateral seal, a lateral cover or a lateral air knife to be removed, but this is possible with minimum effort.

The holder is expediently provided with a corresponding guide, along which the sealing element can be drawn laterally out of the holder.

As already mentioned, the sealing device can be provided, for example, in the area of an air-based device used in particular in a press section or a drying section, such as in particular a steam blower box, a suction box, a stabilizer, ventilation fittings and/or the like.

The sealing element can be formed, for example, by a flexible sealing blade.

According to a preferred embodiment of the apparatus according to the invention, the sealing blade, held at the edges in the holder, can be acted on by a pressing element in such a way that it becomes curved out of the maintenance and/or changing position towards the supporting belt and, as a result, assumes its operating position, in which a sealing section is in the immediate vicinity of the supporting belt.

The unloaded sealing blade held at the edges in the holder is advantageously at least substantially flat, with which it assumes its maintenance or changing position.

The distance between the sealing section of the sealing element and the supporting belt can expediently be set via the pressing element.

The pressing element is preferably formed by a pressing blade, which expediently has a greater stiffness than the sealing blade.

The pressing element can, for example, be accommodated in a recess in a carrier preferably formed by an air-based device. In this case, the recess can be covered at least partly by the pressing blade.

The pressing element can advantageously also be guided out of the holder laterally, that is to say transversely with respect to the web running direction. The holder can again also be provided with a corresponding guide for this purpose.

For the purpose of changing, after the load on the sealing element has been relieved, both the sealing element and the pressing element can be drawn laterally out of the holder provided with corresponding guides, and therefore drawn laterally out of the papermaking machine.

In principle, however, the sealing element can also be formed by a sealing strip. This sealing strip can be mounted fixedly or in a compliant or sprung manner.

According to an expedient practical embodiment of the apparatus according to the invention, the sealing strip is held in a holder which is supported in a sprung manner on the bottom of a recess in a carrier preferably formed by an air-based device.

In specific cases, it is also advantageous if the sealing strip is held in a holder which is pivotably mounted in the area of a recess in a carrier preferably formed by an air-based device.

The holder can be adjustable, for example pivotable, via at least one actuating element. In this case, for example, the use of hydraulic, pneumatic and/or electromechanical actuating elements is conceivable.

The holder can, for example, also be capable of being folded back, so that the sealing element can be removed from the holder after the latter has been folded back.

According to a further advantageous embodiment, in an air-based device, the sealing device separates two zones which can be acted on with different pressures.

In specific cases, it is also advantageous if the sealing device is provided in combination with an air-based device used in the drying section, for example a stabilizer box, as a second sealing device, as viewed in the web running direction, in particular over the machine width, in order in particular to separate an upper and a lower vacuum zone from each other.

In this case, the two vacuum zones can for example be connected to separate vacuum sources.

However, an embodiment is also conceivable in which the two vacuum zones are connected to a common vacuum source, and the pressures in the vacuum zones can be set separately, in particular via flaps or the like. The first sealing device on the inlet side, as viewed in the web running direction, can be formed, for example, by a flexible, floating seal, a mechanical sealing strip or an air knife.

As already mentioned, the sealing device can in particular also be provided for other vacuum boxes, for example in the press section.

During operation, the sealing element is expediently secured against slipping laterally by a locking means, for example cotter pins (and so on).

The holder having the guide for the sealing element can be connected rigidly or in a compliant or sprung manner to the air-based device.

In specific cases, it is also advantageous if the sealing element is provided with a camber, that is to say as viewed over the machine width, has a different distance from the supporting belt, for example a wire. As a result, for example wire deflection between edge and center can be compensated for.

The sealing element can in particular include plastic, for example GRP, Teflon, CRP or the like, or else of another plastic, or of metal.

The two vacuum zones can be sealed off laterally for example via air knives and/or mechanical sealing plates which, in order to release the sealing element, are removable or adjustable, in particular displaceable.

The sealing element can extend over the entire machine width or else only over part of the machine width or can be divided over its width into at least two zones.

The present invention is directed to an apparatus for treating a fibrous web that includes at least one supporting surface arranged to support a surface of the fibrous web, and at least one sealing device positionable adjacent a surface of the web opposite the surface of the web supported by the at least one supporting surface. The at least one sealing device includes a sealing element and a holder structured and arranged to hold and to enable lateral sliding movement of the at least one sealing device cross-wise to a web travel direction.

According to a feature of the invention, the lateral sliding movement can facilitate installation and removal of the at least one sealing device.

In accordance with another feature of the invention, the fibrous web may include at least one of a paper and board web.

Further, at least one supporting belt may be arranged to support and guide the fibrous web over the at least one support surface and past the at least one sealing device. The at least one supporting belt can include at least one of a dewatering belt, press belt, and mesh belt. Still further, the sealing device may be positioned adjacent a surface of the at least one supporting belt opposite the surface supporting the fibrous web. The at least one supporting surface may be structured and arranged to be one of a moving or stationary surface.

According to still another feature of the instant invention, the sealing element may be structured and arranged to form a non-contacting seal with the fibrous web.

In accordance with a still further feature of the present invention, the holder may include a guide structured and arranged to laterally draw the sealing element out of the holder.

An air-based device can be provided, and the sealing device can be coupled to the air-based device. The air-based device may include at least one of a steam blower box, a suction box, a stabilizer, and ventilation fittings. Further, the air based device can be positionable in one of a press section and a drying section.

Moreover, the sealing element can include a flexible sealing blade. Further, a pressing element can be structured and arranged so that, when the sealing blade held in the holder, the pressing element is positionable to move the sealing blade from one of a maintenance or changing position to an operating position, and the pressing element is positionable to move the sealing blade from the operating position to the one of a maintenance or changing position. The sealing blade may include a sealing section, which, when the sealing blade is in the operating position, can be located in vicinity of the surface of the fibrous web opposite the surface supported by the at least one supporting surface. The sealing blade in the one of a maintenance or changing position can be at least substantially flat, and the sealing blade in the operating position can be curved. Still further, a distance of the sealing section of the sealing blade from the fibrous web can be set via the pressing element. A supporting belt can be arranged to guide the fibrous web over the at least one supporting surface and past the at least one sealing device, such that a distance of the sealing section of the sealing blade from the supporting belt can be set via the pressing element. The pressing element may include a pressing blade, and the pressing blade can have a greater stiffness than the sealing blade. The pressing element may be accommodated in a recess in a carrier, and the carrier can include an air-based device. The recess is at least partially covered by the pressing blade, and the pressing element may be structured and arranged to be laterally guidable out of the holder.

In accordance with another feature of the invention, the sealing element can include a sealing strip, The sealing strip can be mounted fixedly. Further, the sealing strip may be mounted in a compliant or sprung manner. The sealing strip can be held in the holder, which is coupled to a recess of a carrier via a spring. Moreover, the spring can be coupled to a bottom of the recess and the carrier comprises an air-based device. The sealing strip may be held in the holder, which is pivotably mounted in an area of a recess in a carrier comprising an air-based device.

An actuating element can be structured and arranged to pivotably adjust the holder.

According to still another feature of the invention, the holder may include a guide element that is pivotable relative to the sealing element to facilitate removal of the sealing element.

Further still, an air-based device can be provided, and the sealing device may be structured and arranged to separate two zones which are acted on with different vacuum pressures.

The apparatus can be provided in combination with an air-based device positioned within a drying section, such that the combination includes the sealing device positioned as an intermediate seal to separate an upper and a lower vacuum zone from each other. Further, the air-based device can include a stabilizer box. The two vacuum zones may be couplable to separate vacuum sources, or the two vacuum zones may be couplable to a common vacuum source. The two vacuum zones may also be separately settable via flaps. A second seal, located upstream, relative to the web travel direction, from the intermediate seal can be one of a flexible, floating seal, a mechanical sealing strip and an air knife. A locking device can be structured and arranged to secure the sealing element from laterally slipping out of the holder. The locking device may include one of a cotter pin and a clamp. The holder can have a guide structured to receive the sealing element that is one of rigidly connected or in a compliant or sprung manner to the air-based device. The sealing element may include a camber. Further, the sealing element can include at least one of plastic or metal, and the plastic may include at least one of GRP, Teflon, CRP. The two vacuum zones may be laterally sealable via at least one of air knives and mechanical sealing plates which, in order to release the sealing element, are at least one of removable and adjustable.

According to still another feature of the invention, the sealing element may extend over an entire machine width.

In accordance with still yet another feature of the present invention, the sealing element may extend over only a part of a machine width or is subdivided over its width into at least two zones.

The present invention is directed to an apparatus for treating a fibrous web that includes at least one supporting surface arranged to support a surface of the fibrous web, at least one supporting belt arranged to guide and support the fibrous web over the at least one supporting surface, and at least one sealing device positionable adjacent a surface of the at least one supporting belt opposite the surface supporting the fibrous web. The at least one sealing device includes a sealing element and a holder structured and arranged to hold and to enable lateral sliding movement of the at least one sealing device cross-wise to a web travel direction.

Other exemplary embodiments and advantages of the present invention may be ascertained by reviewing the present disclosure and the accompanying drawings.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description is taken with the drawings making apparent to those skilled in the art how the forms of the present invention may be embodied in practice.

Figure 1:
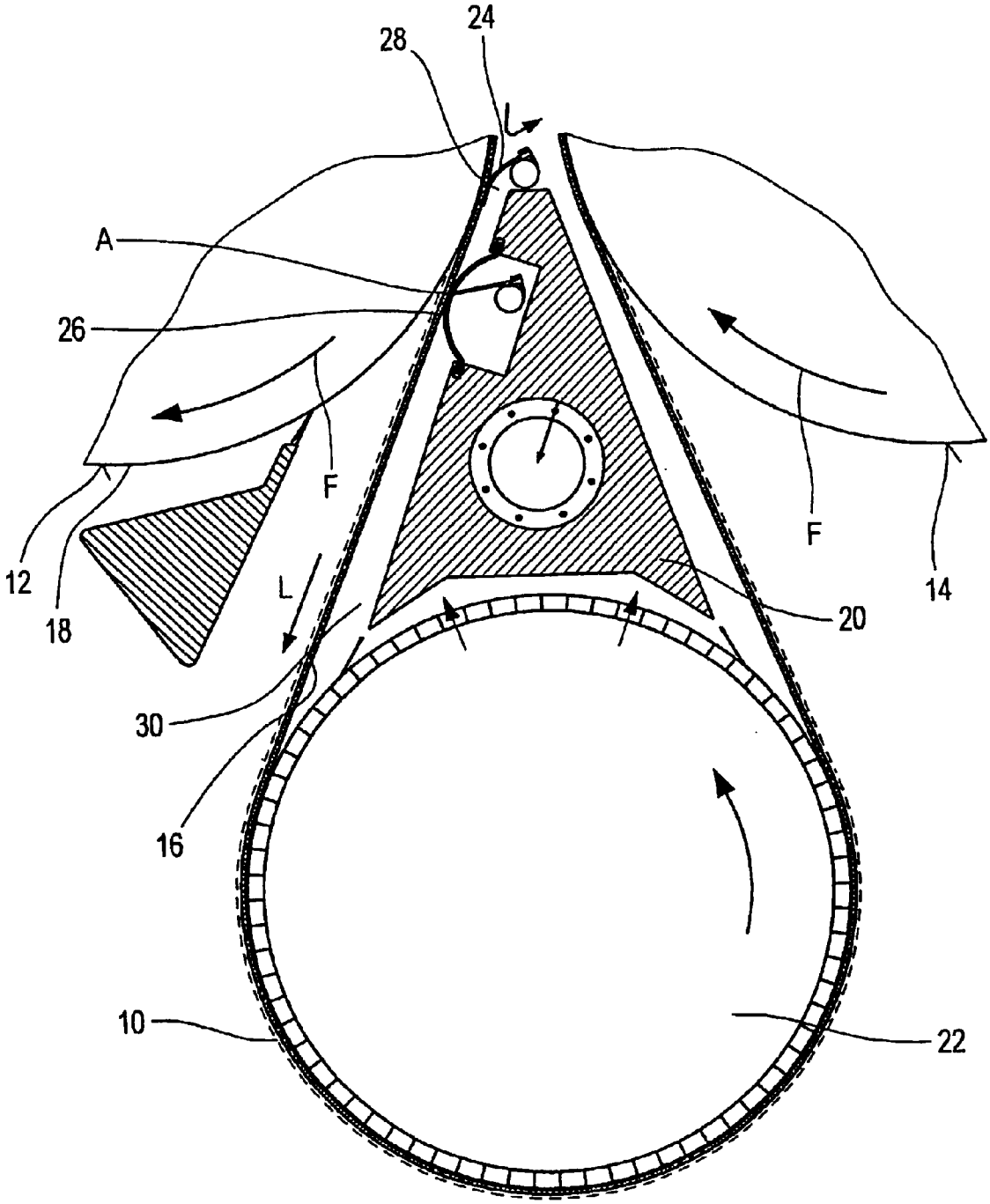
FIG. 1 illustrates a purely schematic part view of a drying section of an apparatus for treating a fibrous web, having a sealing device which is associated with a drying cylinder and whose sealing element is formed by a flexible sealing blade.

FIG. 1 shows a schematic part view of a drying section of an apparatus for treating a fibrous web, having two seals provided in the area of a drying cylinder, in the upper area of a stabilizer box for forming an upper and a lower vacuum zone.

The relevant apparatus is used for the treatment of a fibrous web 10 such as in particular a paper and/or board web.

Indicated in FIG. 1 are two successive drying cylinders 12 and 14, which rotate in the direction of the arrows F and over which, together with the fibrous web 10, a supporting belt 16 is guided which, in the present case, is formed by a drying fabric.

Supporting belt 16, initially guided over the left-hand drying cylinder 12 together with fibrous web 10, runs off supporting surface 18 formed by the outer circumferential surface of drying cylinder 12, together with fibrous web 10, in a run-off area A, in order then to be fed in the web running direction L for example to a perforated and/or grooved deflection roll 22 to which vacuum is applied by an external stabilizer box 20, merely indicated. In the present case, stabilizer box 20 can in particular be a suction box or the like. In principle, however, the sealing arrangement described in more detail in the following text can also be provided in the area of other air-based devices.

On the side of fibrous web 10 that faces away from supporting surface 18 and on the side of supporting belt 16 that faces away from supporting surface 18, in web running direction L, a first seal 24 is provided upstream of run-off area A. This first sealing device on the inlet side can be, for example, a flexible, floating seal, a mechanical sealing strip or an air knife.

Following first seal 24, a second seal or sealing device 26 arranged downstream of the run-off area A is provided, so that the result is an upper and a lower vacuum zone 28 and 30. Vacuum is applied to the upper vacuum zone via at least one vacuum channel 32 (cf. in particular FIGS. 2 and 3). Lower vacuum zone 30 is used, inter alia, to stabilize the web guidance. Upper vacuum zone 28 is used in particular as a "ProRelease" or separation zone. The arrangement is therefore used overall for the controlled separation and stabilization of fibrous web 10.

Sealing device 26 comprises a sealing element held in a holder 34 (cf. in particular also FIGS. 2 and 3), which in the following case is implemented as a flexible sealing blade 35.

Figure 3:
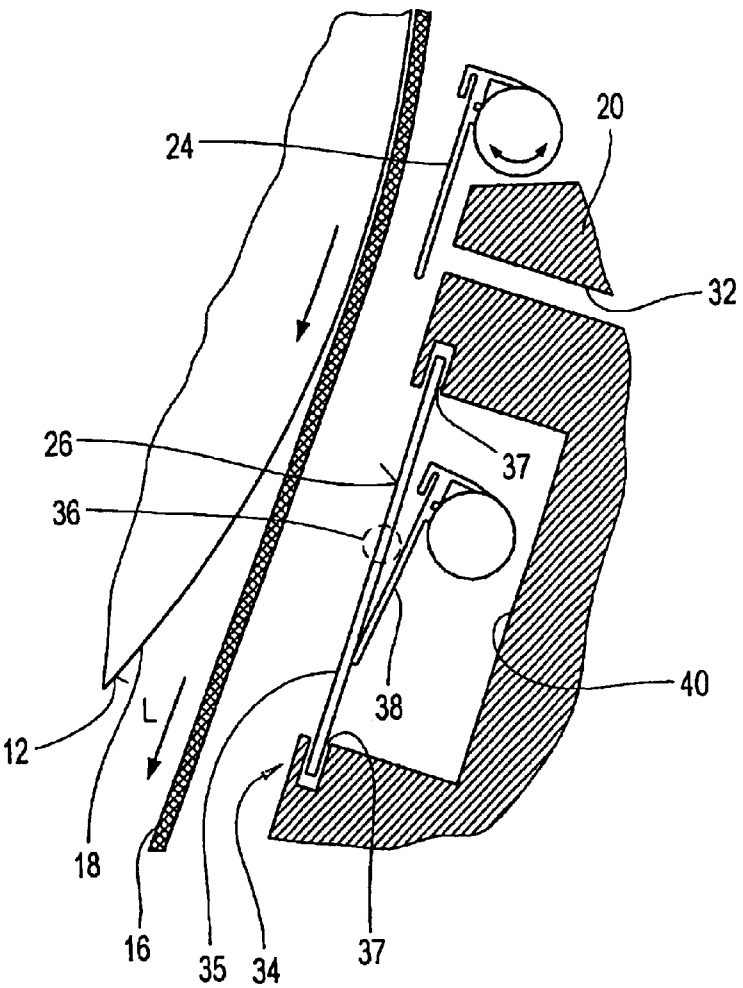
FIG. 3 illustrates the enlarged illustration of the sealing device depicted in FIG. 1 in its maintenance or changing position.
Figure 2:
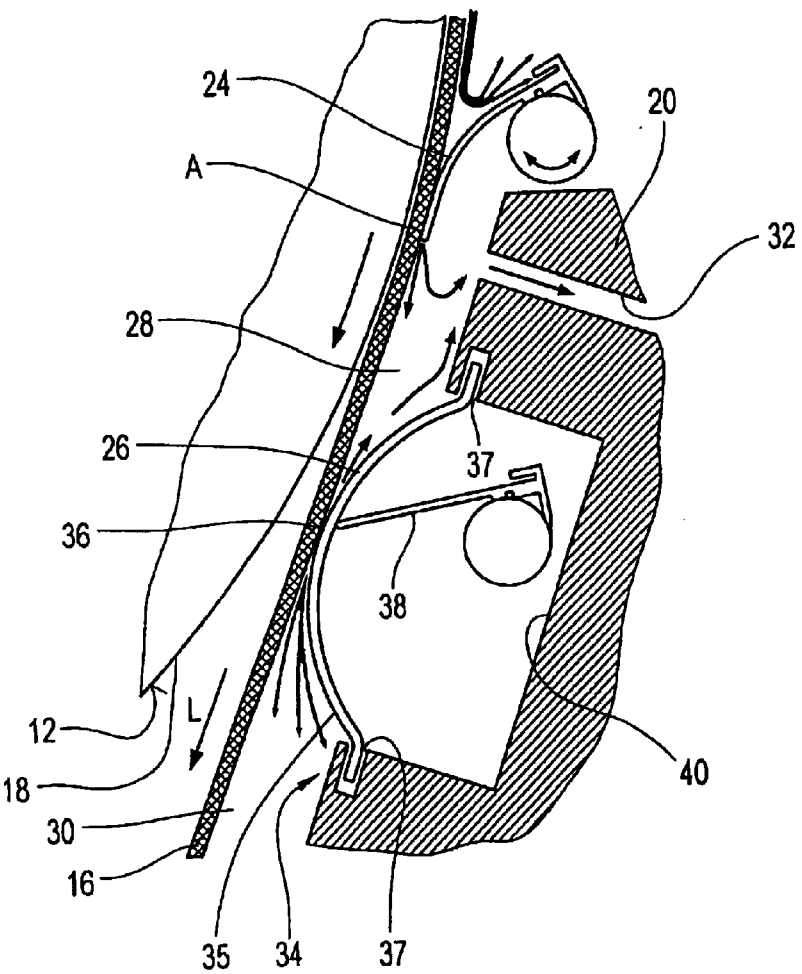
FIG. 2 illustrates an enlarged illustration of the sealing device depicted in FIG. 1 in its operating position.

As can best be seen by using FIGS. 2 and 3, sealing blade 35 can be adjusted between an operating position (cf. FIG. 2), in which a sealing section 36 of sealing element 35 is arranged in the immediate vicinity of the supporting belt 16, and a maintenance and/or changing position (cf. FIG. 3), in which the sealing section 36 is at a greater distance from the supporting belt 16. In this case, the sealing blade 35 can be guided out of holder 34 laterally, that is to say transversely to the web running direction L, in particular when it assumes its maintenance or changing position. Sealing blade 35, forming a wearing part, can therefore be drawn laterally out of holder 34 without difficulty and without stabilizing box 20 having to be dismantled for this purpose. Before sealing blade 35 is drawn out, it may be necessary for a lateral seal, a lateral cover, a lateral air knife or the like to be removed, but this is possible with minimum effort.

Holder 34 which, in the present case, is provided on stabilizer box 20, is provided with a corresponding guide 37, along which sealing blade 35 can be drawn laterally out of holder 34.

As can be seen in particular by using FIGS. 2 and 3, sealing blade 35 is held in guide 37 of holder 34 at its two edges running transversely with respect to the web running direction L. Here, it can be acted on via a pressing element 38 in such a way that it becomes curved inwards towards supporting belt 16 and, as a result, assumes its operating position.

As can be seen in FIG. 3, unloaded sealing blade 35 assuming its maintenance or changing position is at least substantially flat.

The distance of sealing section 36 of sealing blade 35 from supporting belt 16 can be set in the desired manner via pressing element 38.

In the present case, pressing element 38 is formed by a pressing blade, pressing blade 38 having a greater stiffness than sealing blade 35. Pressing element 38 formed by a blade is accommodated in a recess 40 in stabilizer box 20, recess 40 being at least partly covered by pressing blade 35.

Pressing element 38 can again be drawn out of holder 34 laterally, that is to say transversely with respect to the web running direction L. In this case, a corresponding guide is again also provided for pressing element 38. After the load on sealing blade 35 has been relieved, sealing blade 35 and the pressing element 38 can therefore individually be drawn laterally out of the machine.

While the sealing element in the embodiment shown in FIGS. 1 to 3 is formed by a flexible sealing blade 35, this sealing element in the embodiments described in FIGS. 4 to 8 is in each case provided with a sealing strip 35'. In this case, the sealing strip 35' can be mounted fixedly or else in a compliant or sprung manner.

Figure 4:
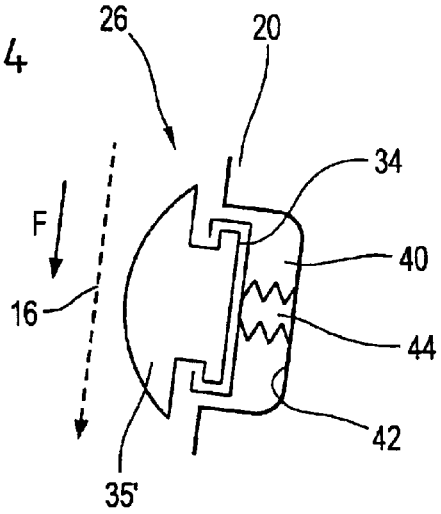
FIG. 4 schematically illustrates a further embodiment of the sealing device, whose sealing element is formed by a sealing strip which is held in a holder which is supported in a sprung manner on the bottom of a recess in the air-based device.

FIG. 4 shows a schematic illustration of an embodiment of sealing device 26 in which sealing strip 35' is held in holder 34, which is supported in a sprung manner on bottom 42 of a recess 40 in stabilizer box 20. Between holder 34 and bottom 48 of recess 40, appropriate spring element 44 are also provided.

Figure 5:
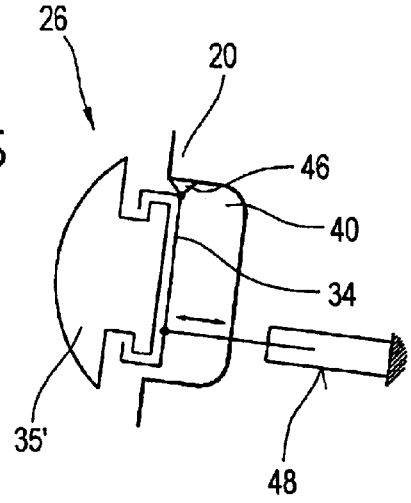
FIG. 5 schematically illustrates a further embodiment of the sealing device, having a sealing strip which is held in a holder which is pivotably mounted in the area of a recess in the air-based device.

FIG. 5 shows a schematic illustration of an embodiment of sealing device 26 in which sealing strip 35' is held in a holder 34 which is pivotably mounted in the area of recess 40 in stabilizer box 20, via a pivoting bearing 46, such that it can be pivoted at least partly into recess 40. Here, holder 34 and therefore sealing strip 35' are adjustable, that is to say pivotable here, via at least one actuating element 48.

Figure 6:
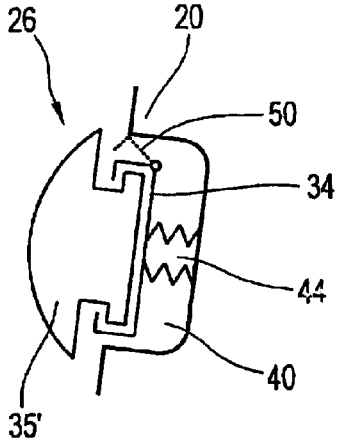
FIG. 6 schematically illustrates a further embodiment of the sealing device, having a sealing strip which is held in a holder that can be folded back.

FIG. 6 shows a schematic illustration of an embodiment of a sealing device 26, comparable with that of FIG. 4, but in which holder 34 can be folded back in the manner indicated dashed. A part 50 of holder 34 can therefore be folded away in order to release the sealing strip 35'.

Otherwise, this embodiment can have at least substantially the same construction as that of FIG. 4. Mutually corresponding parts are assigned the same reference symbols.

Figure 7:
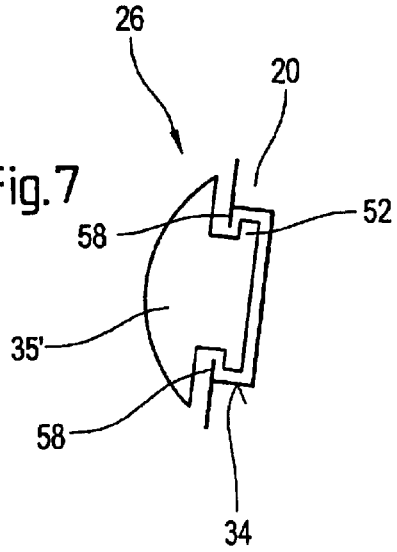
FIG. 7 schematically illustrates a further embodiment of the sealing device, having a sealing strip which is held in a rigid holder.

FIG. 7 shows a schematic illustration of an embodiment of sealing device 26 in which sealing strip 35' is held in a rigid holder 34. Portions 58 extend into recess 40.

Figure 8:
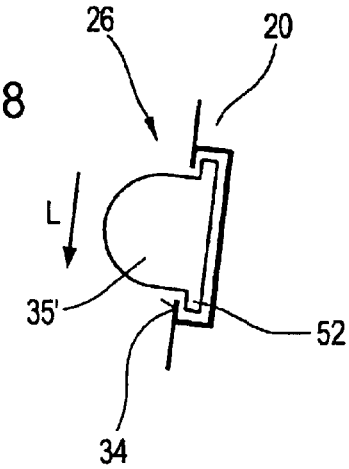
FIG. 8 schematically illustrates a further embodiment of the sealing device, having a sealing strip which is held in a rigid holder.

FIG. 8 shows a further embodiment of sealing device 26, comparable with that of FIG. 7, having a sealing strip 35' which is held in a rigid holder 34.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the invention has been described herein with reference to particular means, materials and embodiments, the invention is not intended to be limited to the particulars disclosed herein. Instead, the invention extends to all functionally equivalent structures, methods and uses, such as are within the scope of the appended claims.

What is claimed:

1. An apparatus for treating a fibrous web comprising:

at least one supporting surface arranged to support a surface of the fibrous web;

at least one sealing device positionable adjacent an opposite surface of the fibrous web;

said at least one sealing device comprising a sealing element and a holder structured and arranged to hold and to enable lateral sliding movement of said sealing element cross-wise to a web travel direction;

a pressing device which moves the sealing element towards the opposite surface of the fibrous web; and the sealing element comprising an outwardly curved surface, wherein the outwardly curved surface is engagable with a moving surface.

2. The apparatus in accordance with claim 1, wherein the lateral sliding movement facilitates installation and removal of said sealing element.

3. The apparatus in accordance with claim 1, wherein the fibrous web comprises at least one of a paper and board web.

4. The apparatus in accordance with claim 1, further comprising at least one supporting belt arranged to support and guide the fibrous web over said at least one supporting surface and past said at least one sealing device.

5. The apparatus in accordance with claim 4, wherein said at least one supporting belt comprises at least one of a dewatering belt, a press belt, and a mesh belt.

6. The apparatus in accordance with claim 4, wherein said at least one sealing device is positioned adjacent a surface of said at least one supporting belt opposite the surface supporting the fibrous web.

7. The apparatus in accordance with claim 4, wherein said at least one supporting surface is structured and arranged to be one of a moving or stationary surface.

8. The apparatus in accordance with claim 1, wherein said at least one sealing element is structured and arranged to form a non-contacting seal with the fibrous web.

9. The apparatus in accordance with claim 1, wherein said holder comprises a guide which is structured and arranged to allow said sealing element to be laterally drawn out of said holder.

10. The apparatus in accordance with claim 1, further comprising an air-based device, and said at least one sealing device is coupled to said air-based device.

11. The apparatus in accordance with claim 10, wherein said air-based device comprises at least one of a steam blower box, a suction box, a stabilizer, and ventilation fittings.

12. The apparatus in accordance with claim 10, wherein said air based device is positionable in one of a press section and a drying section.

13. The apparatus in accordance with claim 1, wherein said sealing element comprises a flexible sealing blade.

14. The apparatus in accordance with claim 13, wherein the pressing device is structured and arranged so that, when said flexible sealing blade is held in said holder, said pressing device is positionable to move said flexible sealing blade from one of a maintenance or changing position to an operating position, and said pressing device is positionable to move said flexible sealing blade from said operating position to the one of the maintenance or the changing position.

15. The apparatus in accordance with claim 14, wherein said flexible sealing blade comprises a sealing section, which, when said flexible sealing blade is in the operating position, is located in vicinity of the opposite surface of the fibrous web.

16. The apparatus in accordance with claim 15, wherein said flexible sealing blade in said one of the maintenance or the changing position is at least substantially flat.

17. The apparatus in accordance with claim 15, wherein said flexible sealing blade in said operating position is outwardly curved.

18. The apparatus in accordance with claim 15, wherein a distance of said sealing section of said flexible sealing blade from the fibrous web can be set via said pressing device.

19. The apparatus in accordance with claim 15, further comprising a supporting belt arranged to guide the fibrous web over said at least one supporting surface and past said at least one sealing device, wherein a distance of said sealing section of said flexible sealing blade from said supporting belt can be set via said pressing device.

20. The apparatus in accordance with claim 1, wherein said pressing device comprises a pressing blade.

21. The apparatus in accordance with claim 20, wherein said pressing blade has a greater stiffness than said flexible sealing blade.

22. The apparatus in accordance with claim 20, wherein said pressing device is accommodated in a recess in a carrier.

23. The apparatus in accordance with claim 22, wherein said carrier comprises an air-based device.

24. The apparatus in accordance with claim 22, wherein said recess is at least partially covered by said pressing blade.

25. The apparatus in accordance with claim 1, wherein said pressing device is structured and arranged to be laterally guidable out of said holder.

26. The apparatus in accordance with claim 1, wherein said sealing element comprises a sealing strip.

27. The apparatus in accordance with claim 26, wherein said sealing strip is mounted fixedly.

28. The apparatus in accordance with claim 26, wherein said sealing strip is mounted in a compliant or sprung manner.

29. The apparatus in accordance with claim 26, wherein said sealing strip is held in said holder, which is coupled to a recess of a carrier via a spring.

30. The apparatus in accordance with claim 29, wherein the spring is coupled to a bottom of said recess and said carrier comprises an air-based device.

31. The apparatus in accordance with claim 26, wherein said sealing strip is held in said holder, the sealing strip being pivotably mounted in an area of a recess in a carrier comprising an air-based device.

32. The apparatus in accordance with claim 1, wherein said holder comprises a guide element that is pivotable relative to said sealing element to facilitate removal of said sealing element.

33. The apparatus in accordance with claim 1, further comprising an air-based device, and said at least one sealing device is structured and arranged to separate two zones which are acted on with different vacuum pressures.

34. The apparatus in accordance with claim 1, wherein said sealing element extends over an entire machine width.

35. The apparatus in accordance with claim 1, wherein one of:

said sealing element extends over only a part of a machine width; and said sealing element is subdivided over its width into at least two zones.

36. The apparatus in accordance with claim 1, wherein the sealing element is bendable into a curved arrangement which includes the outwardly curved surface.

37. An apparatus for treating a fibrous web comprising:

at least one supporting surface arranged to support a surface of the fibrous web;

at least one sealing device positionable adjacent an opposite surface of the fibrous web;

said at least one sealing device comprising a sealing element and a holder structured and arranged to hold and to enable lateral sliding movement of said sealing element cross-wise to a web travel direction;

a pressing device which moves the sealing element towards the opposite surface of the fibrous web;

the sealing element comprising an outwardly curved surface; and an actuating element structured and arranged to pivotably adjust said holder.

38. An apparatus for treating a fibrous web in combination with an air-based device positioned within a drying section, said combination comprising:

at least one supporting surface arranged to support a surface of the fibrous web;

at least one sealing device positionable adjacent an opposite surface of the fibrous web;

said at least one sealing device comprising a sealing element and a holder structured and arranged to hold and to enable lateral sliding movement of said sealing element cross-wise to a web travel direction;

said at least one sealing device being positioned as an intermediate seal to separate an upper and a lower vacuum zone from each other.

39. The apparatus in accordance with claim 38, wherein said air-based device comprises a stabilizer box.

40. The apparatus in accordance with claim 38, wherein said upper and lower vacuum zones are couplable to separate vacuum sources.

41. The apparatus in accordance with claim 38, wherein said upper and lower vacuum zones are couplable to a common vacuum source.

42. The apparatus in accordance with claim 38, wherein said upper and lower vacuum zones are separately settable via flaps.

43. The apparatus in accordance with claim 38, further comprising a second seal, located upstream, relative to the web travel direction, from said intermediate seal, wherein the second seal comprises one of a flexible seal, a floating seal, a mechanical sealing strip and an air knife.

44. The apparatus in accordance with claim 38, further comprising a locking device structured and arranged to secure said sealing element from laterally slipping out of said holder.

45. The apparatus in accordance with claim 44, wherein said locking device comprises one of a cotter pin and a clamp.

46. The apparatus in accordance with claim 38, wherein said holder has a guide structured to receive said sealing element and wherein said holder is one of rigidly connected to said air-based device and connected in a compliant or sprung manner to said air-based device.

47. The apparatus in accordance with claim 38, wherein said sealing element comprises a flexible strip and wherein opposite side edges of the flexible strip are retained in grooves of said holder.

48. The apparatus in accordance with claim 38, wherein said sealing element comprises at least one of a plastic and a metal.

49. The apparatus in accordance with claim 48, wherein the plastic comprises at least one of GRP, Teflon, and CRP.

50. The apparatus in accordance with claim 38, wherein said upper and lower vacuum zones are laterally sealable via at least one of air knives and mechanical sealing plates which, in order to release said sealing element, are at least one of removable and adjustable.

51. An apparatus for treating a fibrous web comprising:

at least one supporting surface arranged to support a surface of the fibrous web;

at least one supporting belt arranged to guide and support the fibrous web over said at least one supporting surface;

at least one sealing device positionable adjacent a surface of said at least one supporting belt opposite the surface supporting the fibrous web;

said at least one sealing device comprising a sealing element and a holder structured and arranged to hold and to enable lateral sliding movement of said sealing element cross-wise to a web travel direction;

a pressing device which moves the sealing element towards the at least one supporting belt; and one of:

the sealing element having an outwardly curved surface which is arranged to engage the at least one supporting belt; and the sealing element being a flexible sealing blade which can be bent into a curved arrangement, wherein the curved arrangement includes an outwardly curved surface that is arranged to engage the at least one supporting belt.

52. An apparatus for treating a fibrous web comprising:

a movable belt comprising a first surface arranged to support the fibrous web and an opposite facing second surface;

a first sealing device positionable adjacent the second surface;

said first sealing device comprising a flexible blade and a holder;

the holder being structured and arranged to hold and to enable lateral sliding movement of the flexible blade cross-wise to a web travel direction, wherein opposite side edges of the flexible blade are retained in grooves of said holder; and the flexible blade comprising an outwardly curved surface, wherein the outwardly curved surface is engagable with a moving surface.

53. The apparatus in accordance with claim 52, further comprising a pressing device which moves the flexible blade towards the second surface.

54. The apparatus in accordance with claim 52, further comprising a second sealing device located upstream relative to the web travel direction, wherein the second sealing device contacts the second surface.

55. The apparatus in accordance with claim 52, wherein the holder is arranged on an air-based device.

56. The apparatus in accordance with claim 52, wherein the flexible blade is capable of assuming a substantially flat arrangement in one position and being bendable into a curved arrangement in another position.

57. The apparatus in accordance with claim 52 in combination with an air-based device positioned within a drying section, said combination comprising:

said first sealing device being positioned to separate upper and a lower vacuum zones from each other.

58. An apparatus for treating a fibrous web comprising:

a movable belt comprising a first surface arranged to support the fibrous web and an opposite facing second surface;

a first sealing device positionable adjacent the second surface;

said first sealing device comprising a holder and a sealing strip having an outwardly curved surface; and the holder being structured and arranged to hold and to enable lateral sliding movement of the sealing strip cross-wise to a web travel direction, wherein opposite side edges of the sealing strip are retained by said holder, and wherein the outwardly curved surface is engagable with the second surface.

59. The apparatus in accordance with claim 58, further comprising a second sealing device located upstream relative to the web travel direction, wherein the second sealing device contacts the second surface.

60. The apparatus in accordance with claim 58, wherein the holder is arranged on an air-based device.

61. The apparatus in accordance with claim 58, wherein the holder is movably mounted to an air-based device.

62. The apparatus in accordance with claim 61, further comprising a pressing device which moves the holder towards the second surface.

63. The apparatus in accordance with claim 61, further comprising a spring element which moves the holder towards the second surface.

64. The apparatus in accordance with claim 58, wherein the holder is arranged in a recess of an air-based device.

65. The apparatus in accordance with claim 64, further comprising a pressing device which moves the holder towards the second surface.

66. The apparatus in accordance with claim 58, wherein the holder comprises a pivotally mounted portion.

67. The apparatus in accordance with claim 58, wherein the holder comprises edges which extend into grooves of the sealing strip.

68. The apparatus in accordance with claim 58, wherein the holder comprises projecting portions which extend adjacent to the opposite side edges.

69. A method of removing or replacing a sealing element in an apparatus for treating a fibrous web which comprises a movable belt comprising a first surface arranged to support the fibrous web and an opposite facing second surface, a first sealing device positionable adjacent the second surface, said first sealing device comprising a holder and a sealing element having an outwardly curved surface, the holder being structured and arranged to hold and to enable lateral sliding movement of the sealing strip cross-wise to a web travel direction, wherein opposite portions of the sealing strip are retained by said holder, and wherein the outwardly curved surface is engagable with the second surface, the method comprising:

guiding the sealing element laterally out of the holder when the sealing element is worn.

70. The method of claim 69, further comprising, before the guiding, moving the sealing element away from the second surface.

71. The method of claims 69, further comprising bending the sealing element into a curved arrangement which includes the outwardly curved surface and thereafter unbending the sealing element.

* * * * *